US007980642B2

(12) United States Patent
Lam et al.

(10) Patent No.: US 7,980,642 B2
(45) Date of Patent: Jul. 19, 2011

(54) DRAWER ASSEMBLY

(75) Inventors: Harn Lian Lam, Perak (MY); Harn Yan Lam, Perak (MY)

(73) Assignee: Harn Marketing SDN. BHD., Ipoh, Perak (MY)

( * ) Notice: Subject to any disclaimer, the term of this patent is extended or adjusted under 35 U.S.C. 154(b) by 469 days.

(21) Appl. No.: 12/147,689

(22) Filed: Jun. 27, 2008

(65) Prior Publication Data

US 2009/0039746 A1 Feb. 12, 2009

(30) Foreign Application Priority Data

Aug. 6, 2007 (MY) ..... PI 20071294

(51) Int. Cl.
*A47B 88/00* (2006.01)

(52) U.S. Cl. ..... 312/334.5; 312/334.6; 312/333; 312/334.7

(58) Field of Classification Search ..... 312/334.6, 312/333, 334.7, 334.8, 334.47, 334.5, 348.1, 312/348.2; 384/21, 22; 248/414, 298.1
See application file for complete search history.

(56) References Cited

U.S. PATENT DOCUMENTS

| | | | | |
|---|---|---|---|---|
| 2,992,057 | A * | 7/1961 | Maxwell | 312/332 |
| 4,961,648 | A | 10/1990 | Rock | |
| 5,026,176 | A * | 6/1991 | Jensen et al. | 384/53 |
| 5,492,400 | A * | 2/1996 | Rock | 312/331 |
| 6,095,627 | A * | 8/2000 | Sutterlutti | 312/348.2 |
| 6,913,334 | B2 | 7/2005 | Weichelt | |
| 6,986,558 | B2 | 1/2006 | Egger | |
| 7,156,478 | B2 * | 1/2007 | Harn et al. | 312/334.6 |
| 7,296,863 | B2 * | 11/2007 | Lam et al. | 312/334.6 |
| 7,562,950 | B2 * | 7/2009 | Lam et al. | 312/332 |
| 7,762,637 | B2 * | 7/2010 | Lam et al. | 312/334.6 |
| 2004/0245898 | A1 * | 12/2004 | Amann et al. | 312/334.46 |
| 2005/0231083 | A1 * | 10/2005 | Garcie, Jr. | 312/333 |
| 2006/0186773 | A1 * | 8/2006 | Lam et al. | 312/334.8 |
| 2006/0214548 | A1 * | 9/2006 | Lam et al. | 312/332 |
| 2006/0238089 | A1 * | 10/2006 | Prentner et al. | 312/333 |
| 2008/0203873 | A1 * | 8/2008 | Lautenschlager | 312/334.5 |

FOREIGN PATENT DOCUMENTS

WO 2004103119 A1 12/2004

* cited by examiner

*Primary Examiner* — Janet M Wilkens
*Assistant Examiner* — Dan Rohrhoff
(74) *Attorney, Agent, or Firm* — Volpe and Koenig, P.C.

(57) ABSTRACT

A drawer assembly including a drawer and a sliding guide rail system for slidably opening and closing the drawer within an article of furniture is provided. A support bracket for supporting the drawer is provided at each side of the drawer. The sliding guide rail system includes a pull-out rail disposed within each of the support brackets. One of the support brackets has a slot and the pull-out rail disposed within one of the brackets has a recess. A stabilizer arrangement for stabilizing the sliding movement of the drawer is also provided. The stabilizer arrangement includes a guide bracket and a lever. The guide bracket has a protrusion engageable within the support bracket slot. The guide bracket has a resilient grip portion that allows for the guide bracket protrusion to be adjustable laterally within the support bracket slot when the guide bracket is locked onto the support bracket.

20 Claims, 12 Drawing Sheets

DRAWER ASSEMBLY

FIELD OF INVENTION

The invention relates to a drawer assembly having a drawer and a sliding guide rail system for slidably opening and closing the drawer within an article of furniture. More particularly, this invention relates to a drawer assembly having a stabilizer arrangement for stabilizing the drawer sliding movement and preventing sideways tilting or skewing of the drawer.

BACKGROUND

Typical drawer assemblies generally comprise a drawer with a sliding guide rail system as well as a support member to support the drawer during its sliding movement. Either "full-extension" or "single-extension" type sliding guide rail systems are normally provided for drawers to be either fully or partially slid open or closed. The "full-extension" type guide rail system typically consists of a mounting bracket for fixing the assembly to the article of furniture, a fixed rail mounted on the bracket, a pull out rail attached to the side of the drawer, and preferably an intermediate rail in between the fixed and pull out rails. In the "single-extension" rail system, no intermediate rail is provided and the pull-out rail is directly slidable on a running surface (fixed rail) of the mounting bracket.

Drawers for use with the above drawer assemblies tend to tilt or skew sideways for a variety of reasons among which are excessive/uneven loading and variations in the pre-set measurements of the drawer bottom panel length, the dimension of the article of furniture and/or sliding guide rail system components, due to manufacturing or assembling inaccuracies. Any tilting or skewing of the drawer sideways will affect the smoothness and stability of its sliding movements. As such, it would be desirable for a stabilizer to be provided with drawer assemblies so that the drawer can be slid into and out of an article of furniture smoothly and stably.

An existing drawer assembly having such a stabilizer arrangement was disclosed in Malaysian patent application no. PI 20031897 (published as WO 2004/103119 A1). The existing stabilizer arrangement is provided on the drawer support bracket, at one side of the drawer assembly, and comprises a guide, a lever, a leg and a holder.

The guide comprises a horizontal flange with a pair of legs disposed at each side of the flange. A centrally located protrusion projects downwardly from the horizontal flange. The protrusion is engageable within a slot on the top surface of the support bracket and the legs are insertable into side openings of the support bracket. The protrusion is secured within a recess of the pull-out rail, through the support bracket slot. A serrated portion is provided on the bottom surface of the guide horizontal flange. When the guide is mounted onto the support bracket, the serrated portion of the guide is contactable with a corresponding serrated portion of the top surface of the support bracket.

The lever is an inverted U-shaped bracket having a pair of outwardly stepped planar extensions at a first longitudinal end. The lever is also provided with a centrally located hole as well as a further hole disposed towards the second longitudinal end. The lever is supported on a holder that is fixed onto the top surface of the support bracket. The holder has a vertical flange and a horizontal flange with the vertical flange insertable into the recess of the lever. The vertical flange of the holder is provided with a hole and the lever is pivotally held onto the holder by a screw or rivet through both the holder and central lever holes.

The leg portion of the stabilizer is suitably sized and shaped to fit into the recess of the lever. The leg portion is rotatably mounted onto the lever by way of a fastener through a hole provided at a first end of the leg, that corresponds to the lever hole disposed at the second longitudinal end of the lever. A screw driver slot is provided at a second end of the leg, with that second end sitting on the top surface of the support bracket, when the stabilizer is in an assembled state and in use. The leg portion may be rotated from a release position to a lock position by inserting a screw driver into the slot and rotating it. Rotation of the leg portion to a lock position will cause the second end of the lever, connected to the leg, to be lifted up, thus causing the first end of the lever with extensions to be pressed down onto the guide. The downward pressure from the lever extensions onto the guide coupled with the interaction between the serrated portions of the guide and support bracket will lock the guide thereat. Conversely, rotating the leg in the other direction to a release position will cause the second end of the lever, connected to the leg, to be lowered, lifting the lever extensions from the guide, thus unlocking the guide from the support bracket.

One disadvantage of the prior stabilizer arrangement is the necessity to manually lock the guide in order to secure its position on the support bracket. The first end of the lever, with extensions, will only be urged to press down onto the guide after engagement of the guide protrusion within the pull-out rail recess. There is a clearance between the lever extensions and the guide if the first end of the lever having the extensions is not urged downwards by the rotation of the leg. As such, in the event the user forgets to rotate the leg to the locking position, the extensions of the lever will not be contactable with the guide. No force or pressure will be exerted on the serrated surfaces of the guide or the support bracket and thus, these surfaces would not lock (hold) the guide against lateral movement on the support bracket.

Additionally, the serrated surfaces of the guide and support bracket that enhance locking of the guide onto the support bracket do not allow for minor lateral adjustments of the guide after locking. Such minor adjustments may prove necessary due to inaccuracies in the assembly or manufacturing of the sliding guide rail system components. Also, when side walls of the article of furniture are not parallel to each other, the sliding movement of the pull-out rail will be affected as the guide rail systems are fixed to the furniture walls. Since the sliding movement of the pull-out rail is guided by the guide, the drawer will not be able to open and close smoothly, if the position of the guide cannot be adjusted slightly, to accommodate such variations.

This invention thus aims to alleviate some or all of the problems of the prior art, and to provide a drawer assembly having a stabilizer arrangement that is convenient to use while providing smooth and stable drawer sliding movement.

SUMMARY

In accordance with an aspect of the invention, there is provided a drawer assembly comprising a drawer and a sliding guide rail system for slidably opening and closing the drawer within an article of furniture. A support bracket for supporting the drawer is provided at each side of the drawer. The sliding guide rail system includes a pull-out rail disposed within each of the support brackets. One of the support brackets has a slot and the pull-out rail disposed within that bracket has a recess. The drawer assembly also comprises a stabilizer arrangement for stabilizing the sliding movement of the drawer. The stabilizer arrangement includes a guide bracket and a lever. The guide bracket has a protrusion that is engageable within the support bracket slot, the slot being oversized relative to the guide bracket protrusion such that the protrusion is laterally moveable within the slot. The guide bracket protrusion is secured within the pull-out rail recess through the support bracket slot such that lateral movement of the protrusion within the slot adjusts the position of the pull-out rail relative to one of the support brackets. The stabilizer arrangement further includes a resilient connector operatively connecting the lever with the guide bracket such that the lever is biased to lock the guide bracket onto the support bracket. The guide bracket has a resilient grip portion that allows for the guide bracket protrusion to be adjustable laterally within the support bracket slot when the guide bracket is locked onto the support bracket.

In an embodiment of the invention, the stabilizer arrangement further comprises a holder bracket affixed onto the support bracket, for supporting the lever.

In another embodiment, the connector comprises a horizontal portion and an angled portion, the horizontal portion affixed onto the holder bracket and the angled portion adapted so as to clip onto an end of the lever such that a constant upward force is exerted on the lever at that end. The connector angled portion terminates in a pair of extensions.

According to a further embodiment, the guide bracket grip portion comprises a piece of resilient material disposed on the guide bracket so as to be contactable with the top surface of the support bracket. The resilient material may comprise a rubber material.

In a further embodiment, the grip portion may be integral with the guide bracket.

In yet another embodiment, the support bracket further comprises a pair of edge openings, each edge opening disposed at a side of the support bracket top surface. The guide bracket may further comprise a pair of legs, each of the guide bracket legs insertable into a respective support bracket edge opening such that each leg is disposed between the pull-out rail and the support bracket.

According to another embodiment, the connector is made of spring steel.

The resilient nature of the connector allows the lever to be biased to lock the guide bracket onto the support bracket. As soon as the lever is fixed on the holder bracket and clipped by the connector, constant upward force is exerted by the connector against the clipped end of the lever. This causes the other end of the lever to be urged downwards to bear against the guide bracket, locking the guide bracket thereat. Thus, no manual locking of the guide bracket to the support bracket is necessary.

The resilient nature of the grip portion allows for lateral adjustment of the guide bracket even when the guide bracket is already locked onto the support bracket by the lever. As the sliding movement of the pull-out rail is guided by the guide bracket, it is particularly advantageous that the position of the guide bracket be laterally adjustable so as to ensure the smooth opening or closing of the drawer even if there are inaccuracies or variations in the measurements of the assembly components.

Further, even if the resilient ability of the grip portion changes over time due to normal wear and tear, the advantage of not having to manually lock the guide bracket, as conferred by the resilient connector, remains.

The above-described advantages of the drawer assembly of the present invention therefore, provide for a drawer assembly having a stabilizer arrangement that is convenient to use while providing smooth and stable drawer sliding movement.

BRIEF DESCRIPTION OF THE DRAWINGS

The invention is illustrated, although not limited, by the following description of embodiments made with reference to the accompanying drawings in which.

DETAILED DESCRIPTION OF THE PREFERRED EMBODIMENTS

Figure 1:
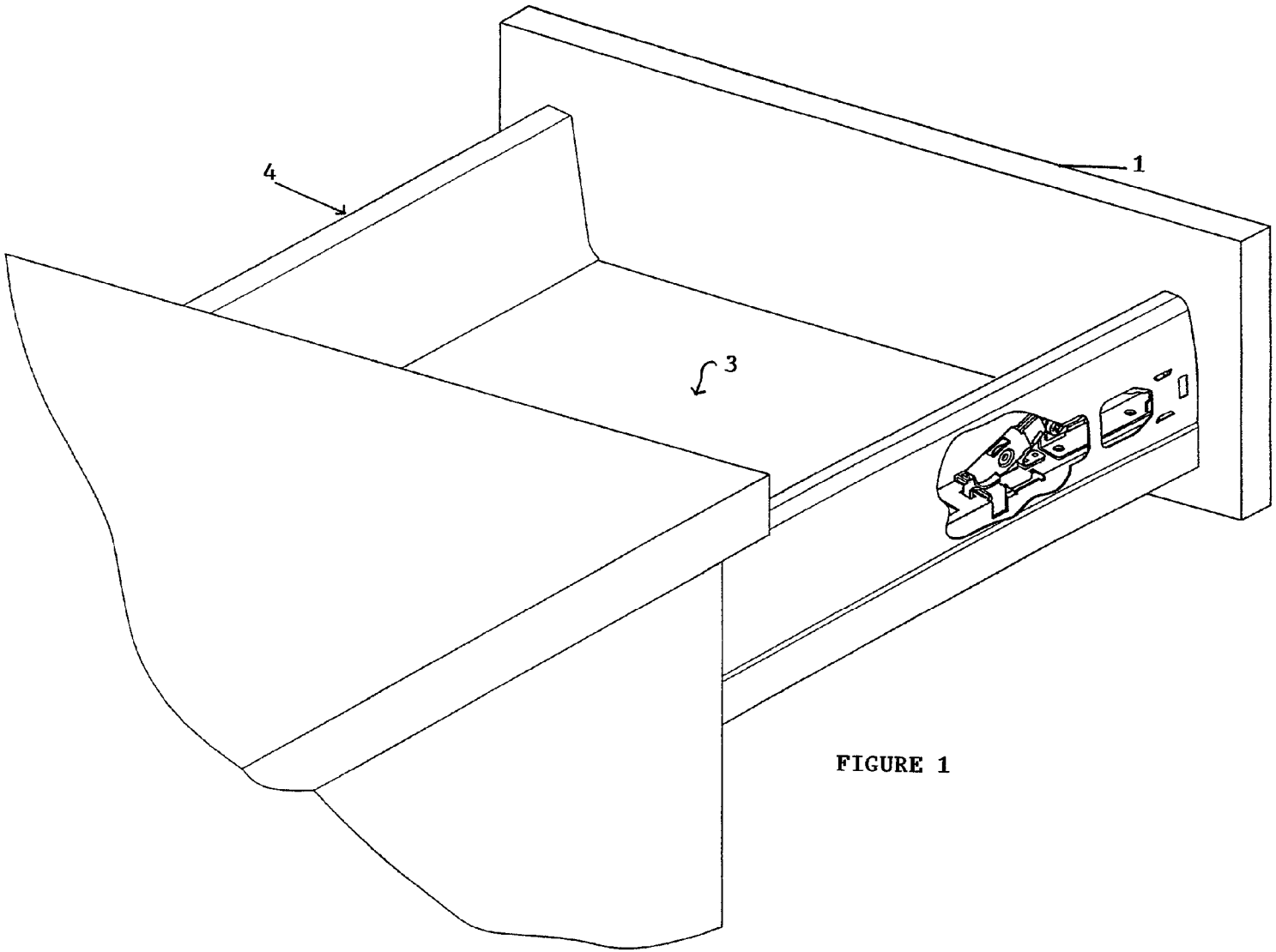
FIG. 1 shows a perspective view of a drawer assembly having a stabilizer arrangement at one side.
Figure 2:
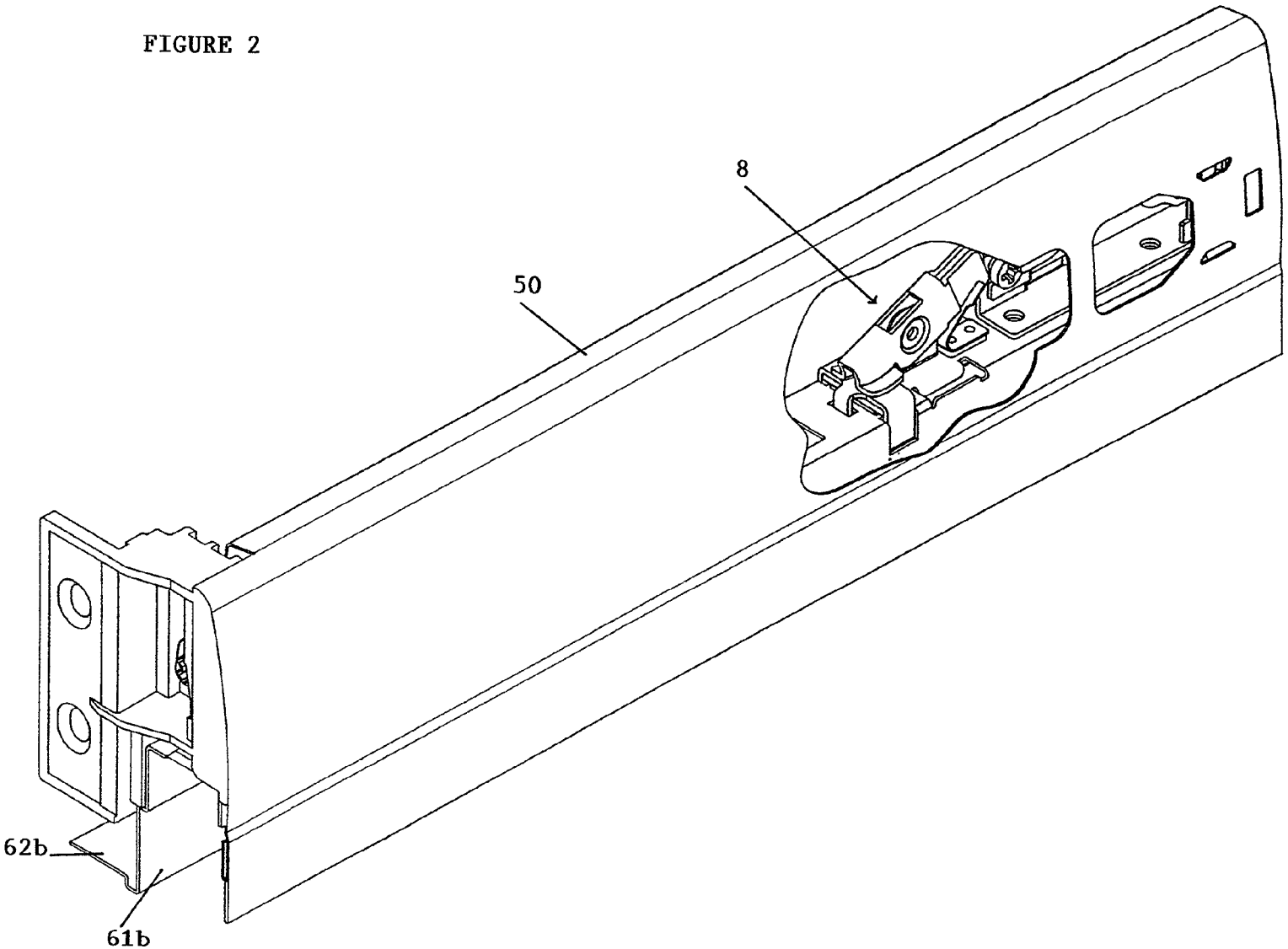
FIG. 2 is a perspective view of the drawer side with the stabilizer arrangement of a drawer assembly of FIG. 1.

FIG. 1 shows a drawer assembly comprising a front panel 1, a rear panel (not seen), a bottom panel 3 as well as drawer sides 4 extending between the front 1 and rear panels at each side of the drawer assembly. The bottom 3, front 1 and rear panels of the drawer are joined to the drawer sides 4 in a conventional manner. As shown in FIG. 2, the drawer sides 4 for use in the drawer assembly are of the "double-walled" type, typically comprising a cover portion 50 that fits over a support bracket 60*a*, 60*b*. Both the cover portion 50 and support brackets 60*a*, 60*b* are preferably made of metal. A sliding guide rail system for slidably opening and closing the drawer is disposed within those support brackets 60*a*, 60*b*.

Figure 8A:
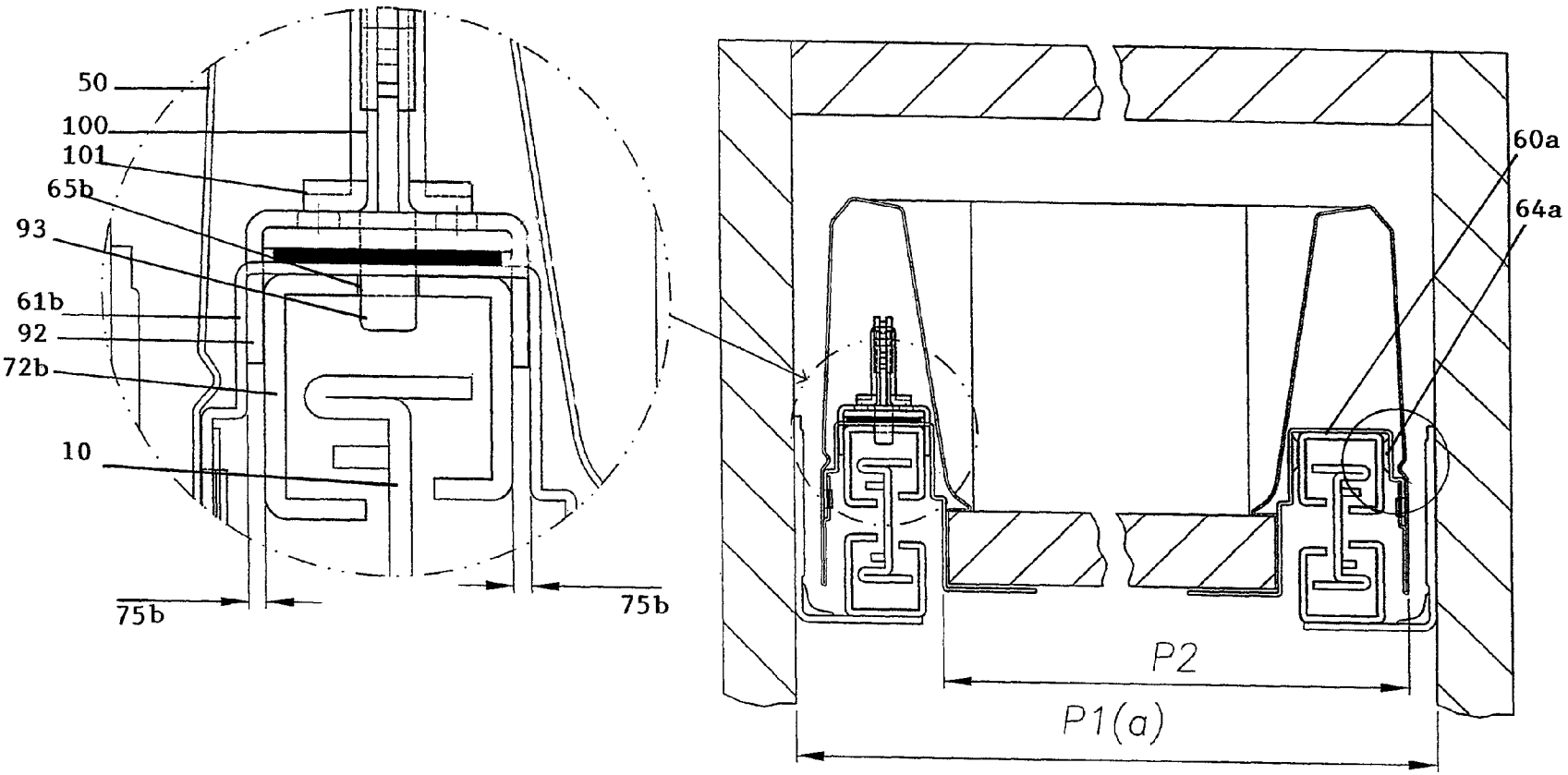
FIGS. 8A, 8B and 8C are sectional views showing a drawer assembly of FIG. 1 with the stabilizer arrangement provided at a drawer side to accommodate a variance in the width of the drawer and furniture carcass.
Figure 8B:
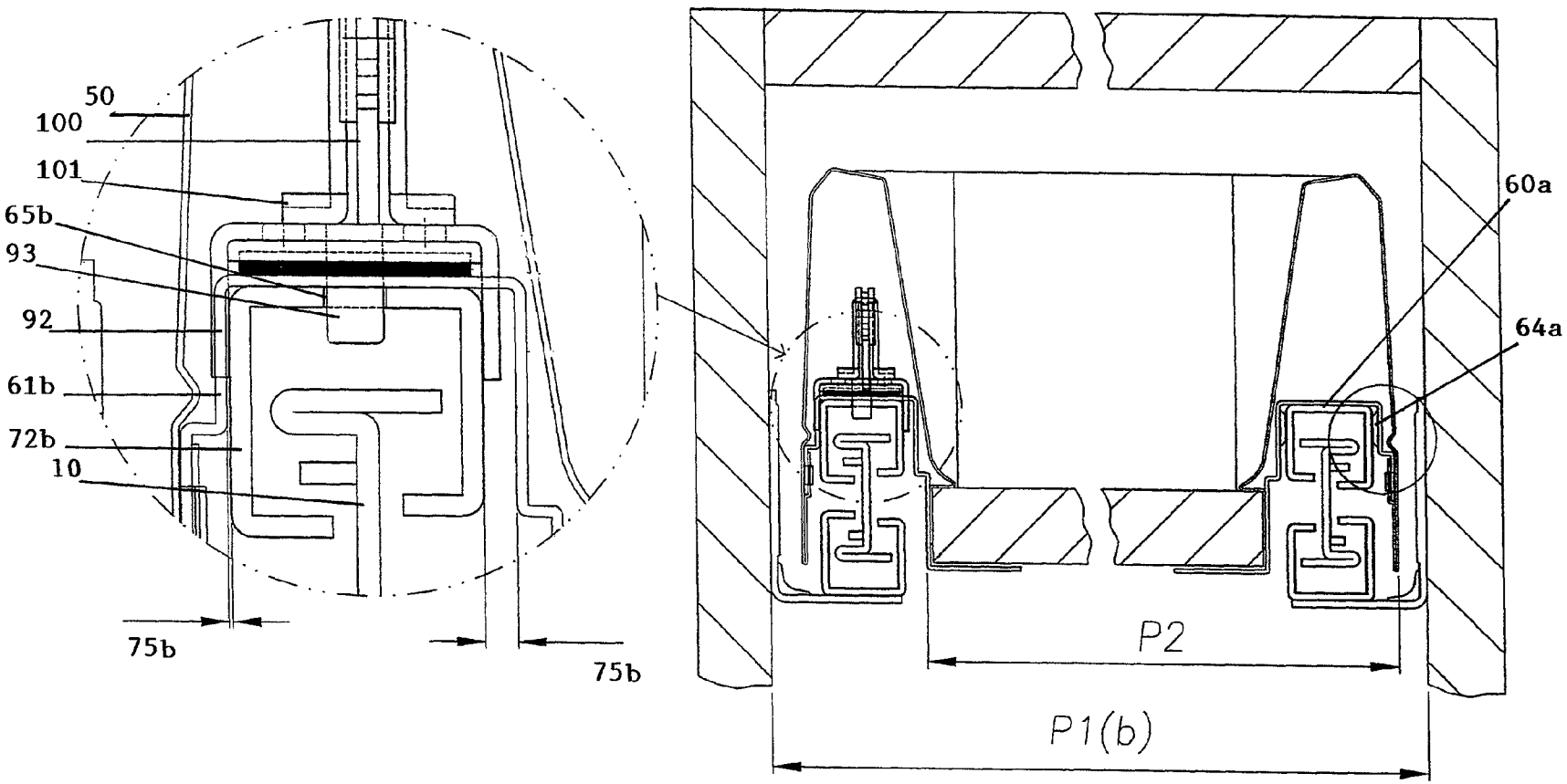

Typically, a sliding guide rail system includes a pull-out rail 70*a*, 70*b* insertable within the open C-section of a support bracket 60*a*, 60*b*. The typical "full-extension" sliding guide rail system, as seen in FIGS. 8A and 8B, generally comprises a mounting bracket for fixing the system to an article of furniture, a fixed guide mounted on the mounting bracket for receiving an intermediate rail 10, the intermediate rail 10 capable of sliding back and forth relative to the fixed guide, and a pull-out rail 70*a*, 70*b* for attachment to the drawer, the pull-out rail being capable of sliding back and forth on the intermediate rail 10. The typical "single-extension" sliding guide rail system generally comprises a mounting bracket for fixing the system to an article of furniture with a pull-out rail 70*a*, 70*b* capable of sliding back and forth on a running surface of the mounting bracket.

Figure 3:
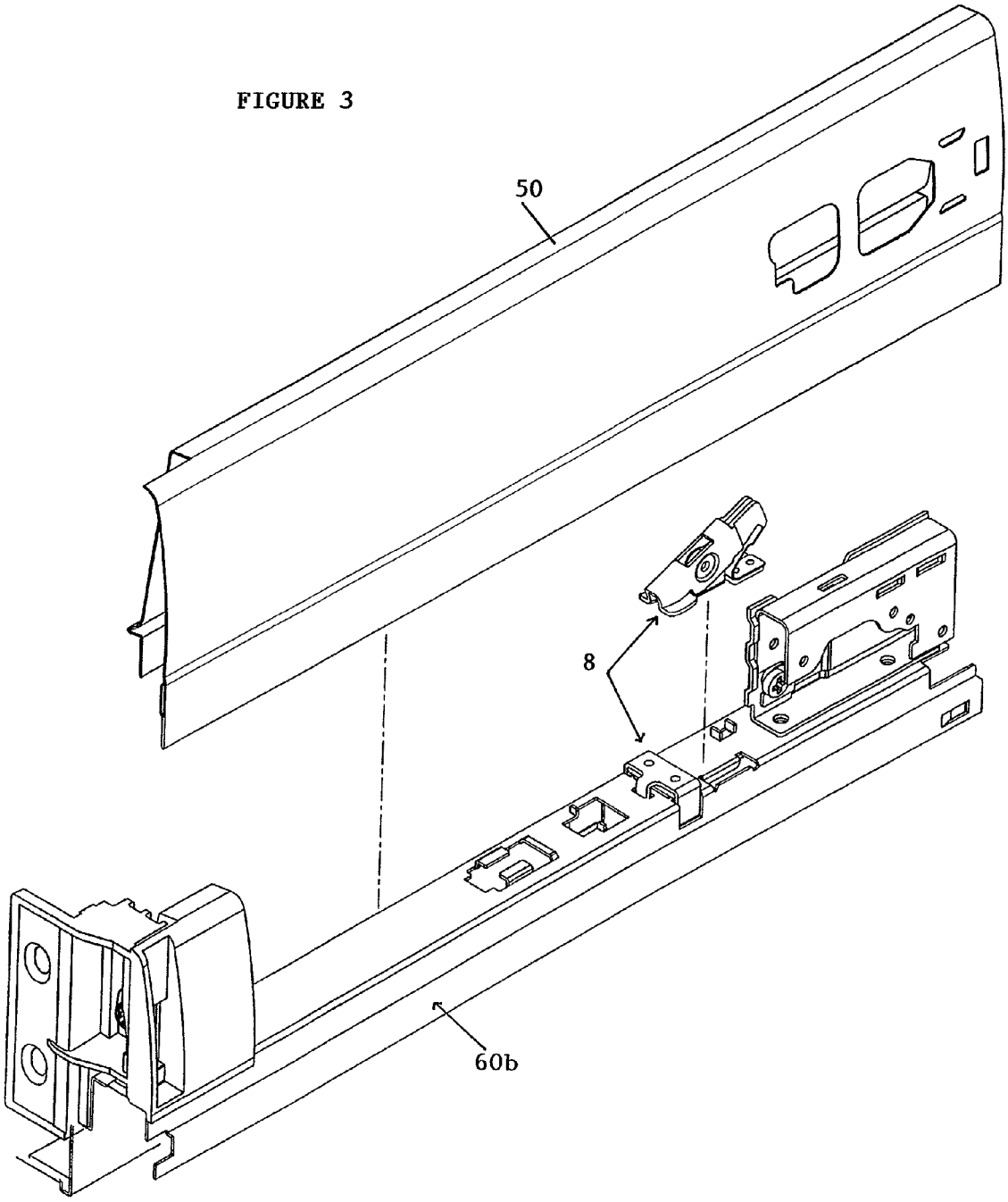
FIG. 3 shows the cover portion and support bracket with stabilizer arrangement of the drawer side of FIG. 2.
Figure 4:
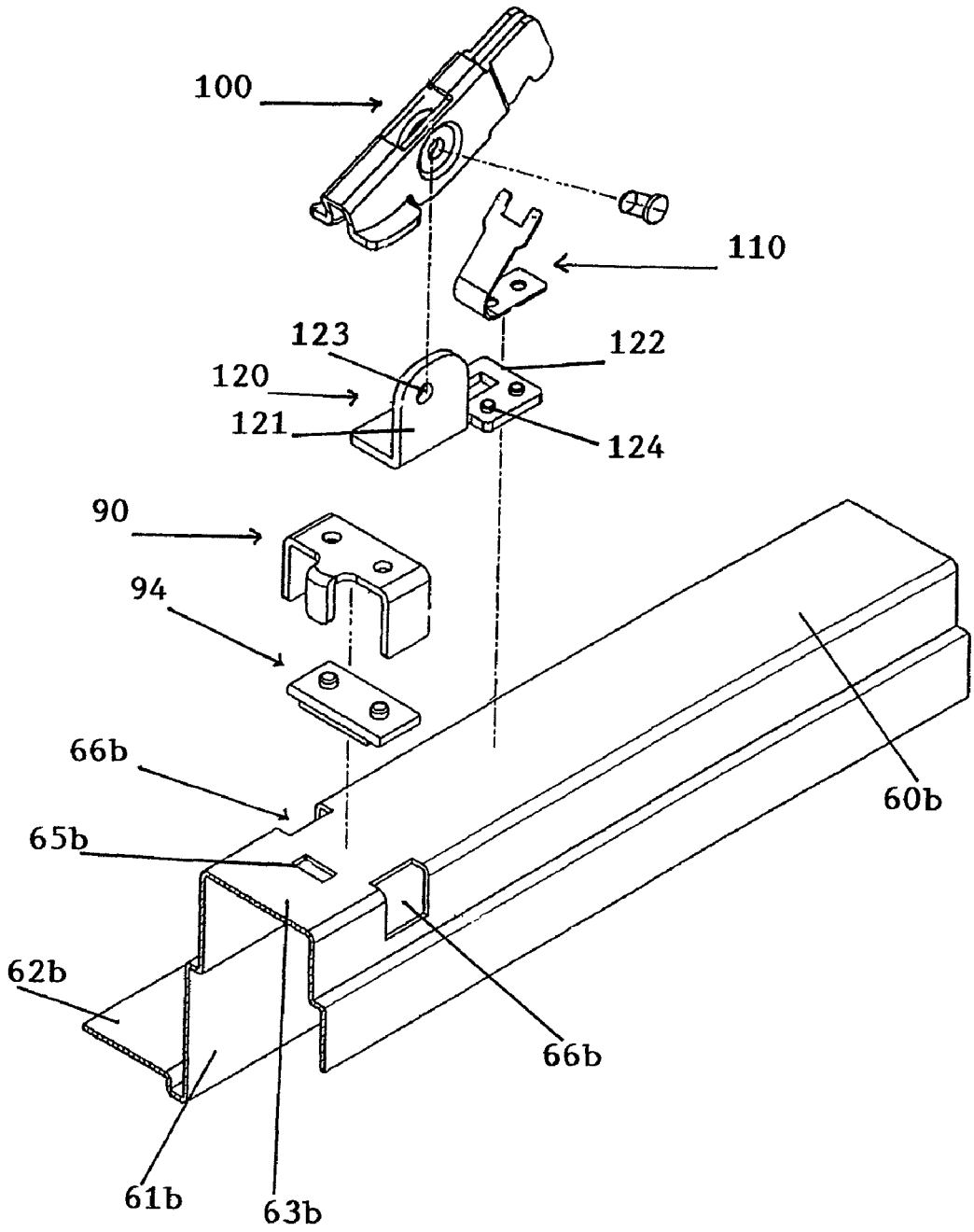
FIG. 4 is an exploded view of the stabilizer arrangement with the support bracket of FIG. 2.
Figure 8C:
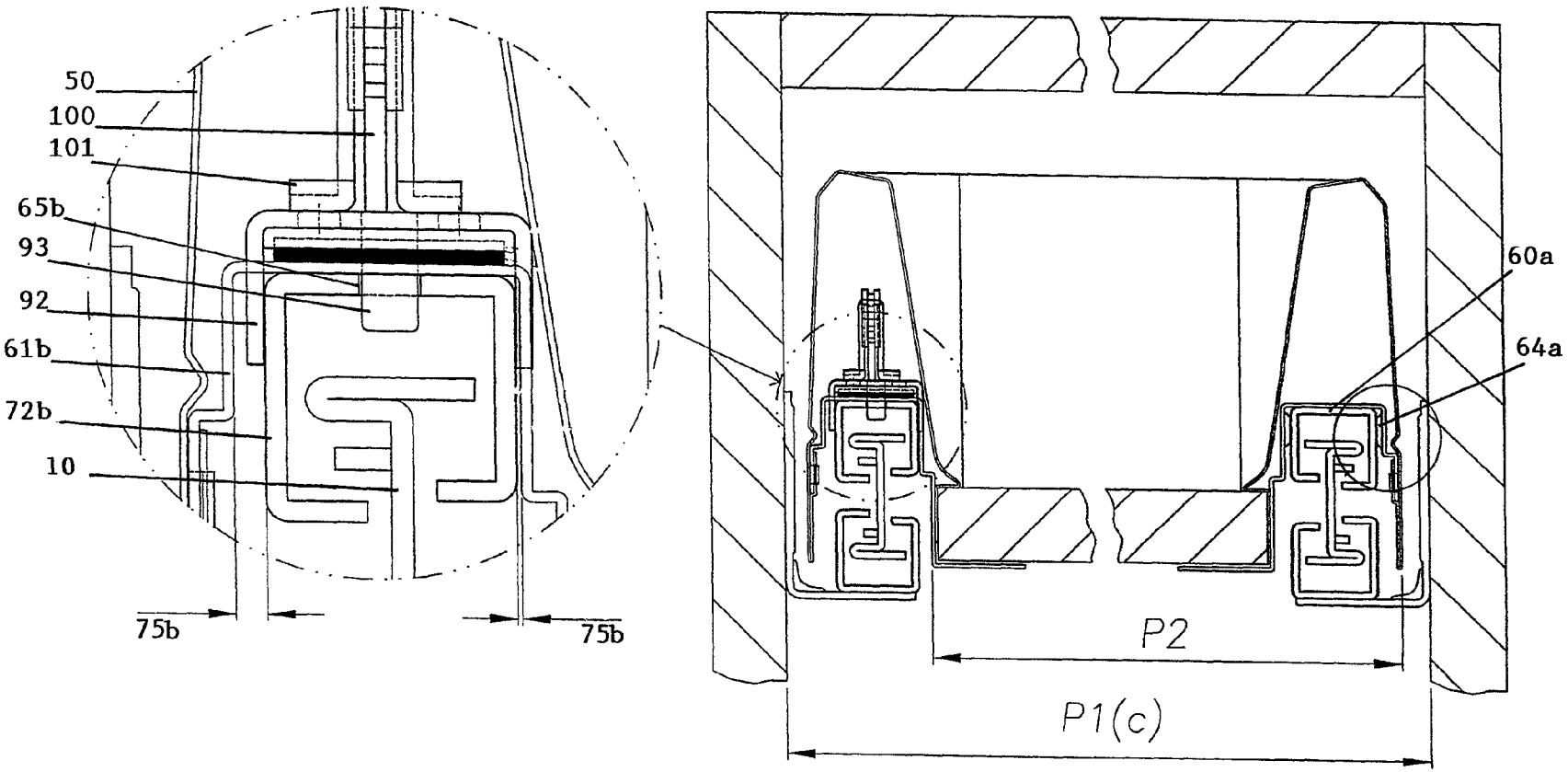

As shown in FIGS. 3 and 4, each drawer support bracket 60*a*, 60*b* is preferably formed from sheet metal into an open C-section having an L-shaped flange disposed lengthwise along its inner side (side of the support bracket 60*a*, 60*b* facing the inside of the drawer assembly). The drawer bottom panel 3 is mountable onto the horizontal portion 62 of the L-shaped flange such that its side abuts against the vertical portion 61 of the L-shaped flange. The top surface 63 of the support bracket 60*a*, 60*b* is adapted to receive an engagement clip (not shown) for releasably engaging a support bracket 60*a*, 60*b* to a pull-out rail 70*a*, 70*b*. FIGS. 8A, 8B and 8C show that a clearance 75 exists at both sides of the pull-out rail 70*a*, 70*b*, between the vertical flanges 72 of the pull-out rail and the inner face of the L-shaped flange vertical portion 61, such that the pull-out rail 70*a*, 70*b* is laterally displaceable within the support bracket 60*a*, 60*b*. Thus, the opening and closing sliding movement of the drawer is caused to be unstable. Members to guide the sliding movement of the pull-out rail are therefore provided at both sides of the drawer.

At one side of the drawer, a pair of guide protrusions 64*a* having a flat surface is provided on both inner faces of the L-shaped flange vertical portion 61*a*. When the support bracket 60*a* is releasably secured with the sliding guide rail system, the pull-out rail 70*a* is located between both these guide protrusions 64*a*. The pull-out rail 70*a* is guided from being laterally displaced by the guide protrusions 64*a* as it slides into or out of the article of furniture. A small clearance exists at each side of the pull-out rail 70*a*, between a guide protrusion 64*a* and a vertical flange 72*a* of the pull-out rail 70*a* so as to enable the sliding movement of the rail. Preferably, the support bracket 60*a* is provided with a pair of guide protrusions 64*a* at both its front and rear longitudinal ends, thus, enabling the pull-out rail 70*a* to be guided at both longitudinal ends. Due to these guide protrusions 64*a* on support bracket 60*a*, the position of support bracket 60*a* relative to pull-out rail 70*a* is fixed i.e. non-adjustable.

As is well-known in the art (shown in FIGS. 8A, 8B and 8C), the width of the drawer bottom panel 3 and/or the article of furniture will occasionally differ from the desired pre-set measurements resulting in variations of distance P2 or P1. The total length of P2 changes in accordance to the variation in length of the drawer bottom panel 3 and the total length of P1 changes in accordance with variations in the dimension of the article of furniture. Such variations in the length of P1 and P2 can be accommodated by adjusting the position of the support bracket 60*b* relative to the pull-out rail 70*b*.

Therefore, unlike support bracket 60*a*, the support bracket 60*b* (FIGS. 3 and 4) is not provided with guide protrusions in order to enable the position of the support bracket 60*b* relative to the pull-out rail 70*b* to be adjustable. If only pull-out rail 70*a* is guided against lateral displacement within support bracket 60*a* and pull-out rail 70*b* is not guided within support bracket 60*b*, the drawer is likely to tilt or skew sideways when it is opened or closed. As such, in order to overcome the lateral displacement of the pull-out rail 70*b* within the support bracket 60*b* and to allow adjustability of the support bracket 60*b* relative to pull-out rail 70*b*, a stabilizer arrangement 8 is provided towards the front of that support bracket 60*b*. In order to accommodate the stabilizer arrangement 8, support bracket 60*b* is provided with a slot 65*b* and a pair of edge openings 66*b*, on its top surface 63. Each edge opening 66*b* is disposed at a side edge of the support bracket top surface 63. Further, the pull-out rail 70*b* is provided with a recess 71*b* at its front longitudinal end.

Figure 6A:
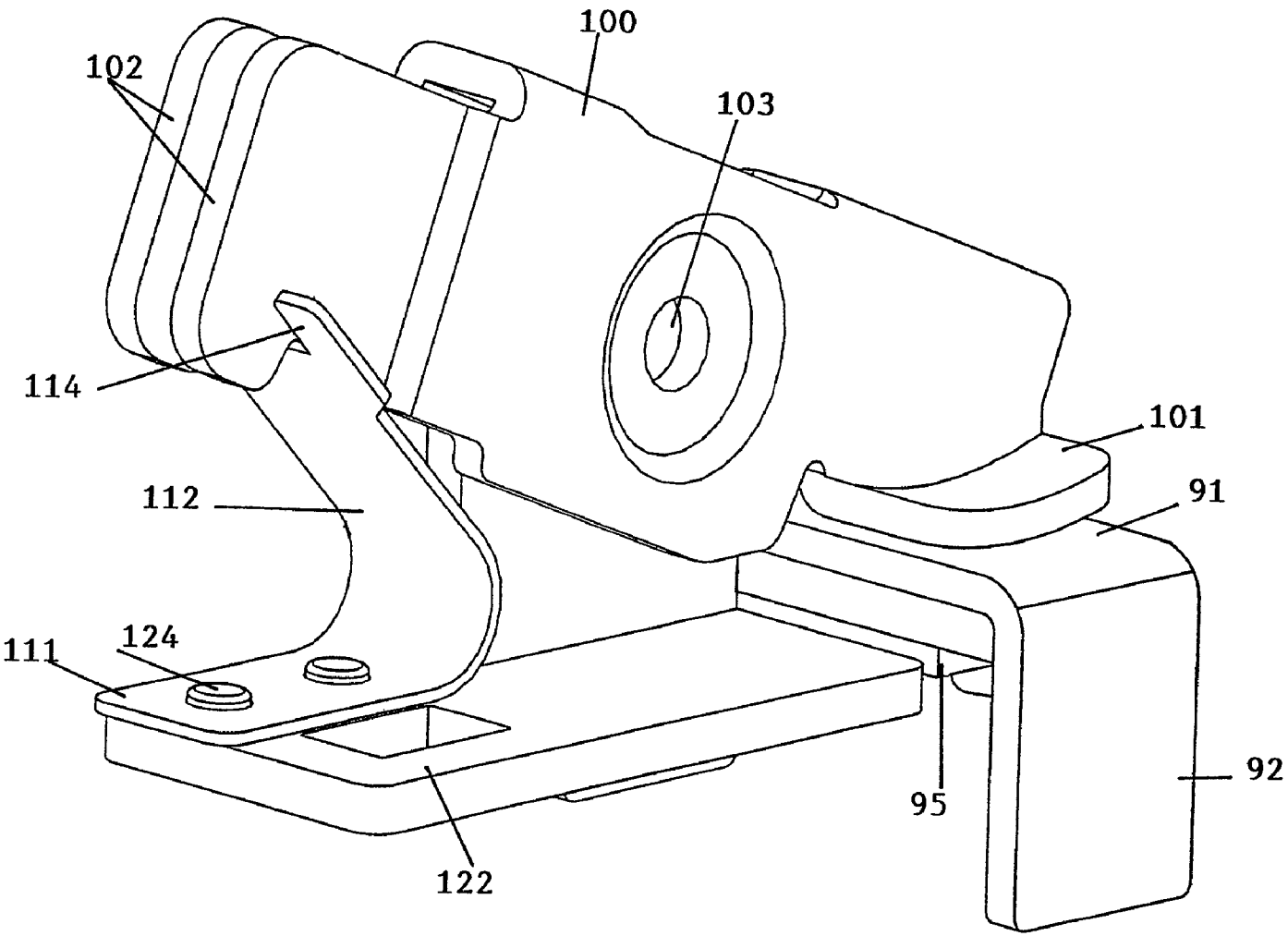
FIG. 6A is a perspective view of the stabilizer arrangement (guide bracket, lever, connector and holder bracket) of FIG. 4.
Figure 6B:
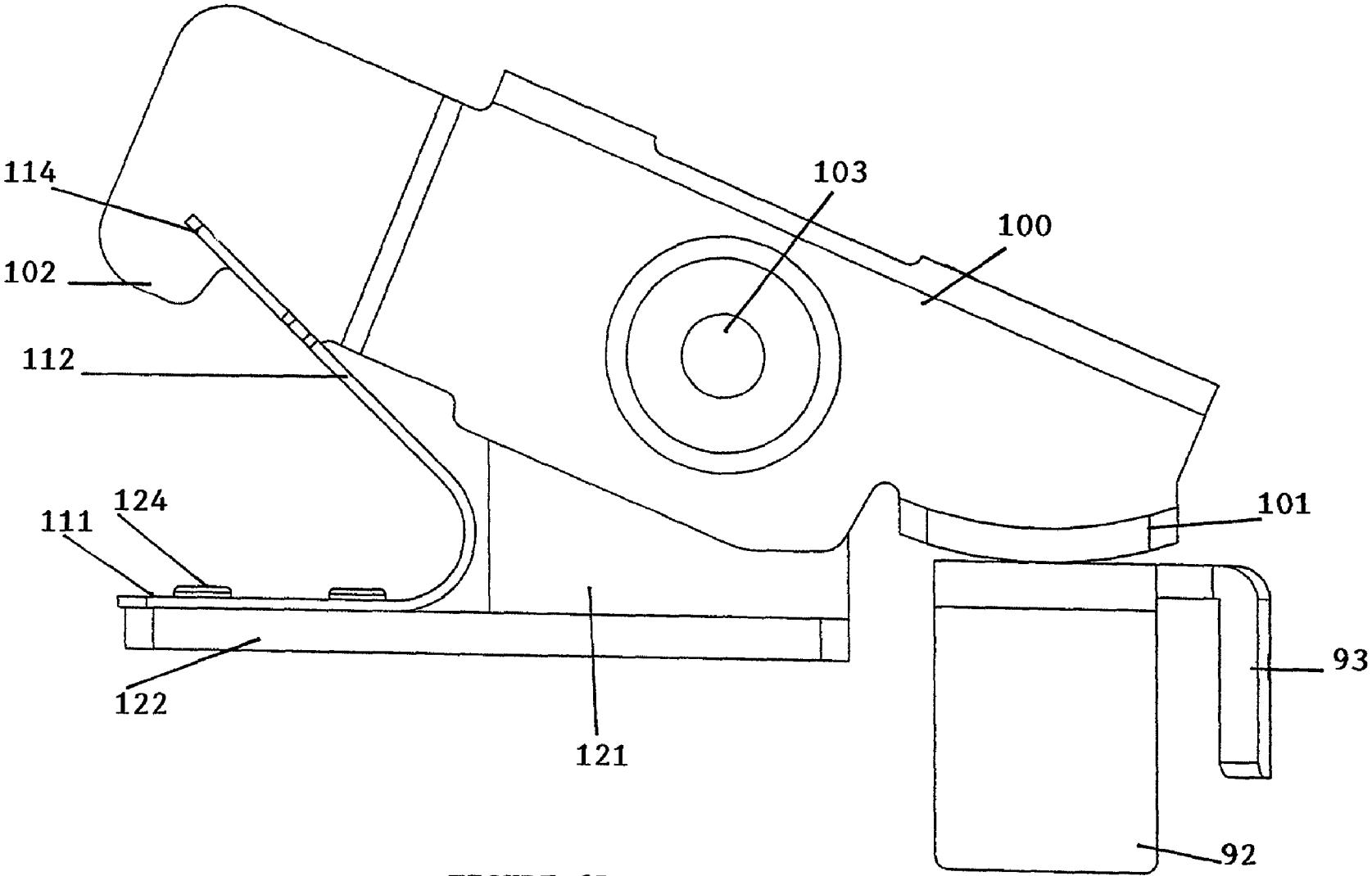
FIG. 6B is a side view of the stabilizer arrangement (guide bracket, lever, connector and holder bracket) of FIG. 4.
Figure 7B:
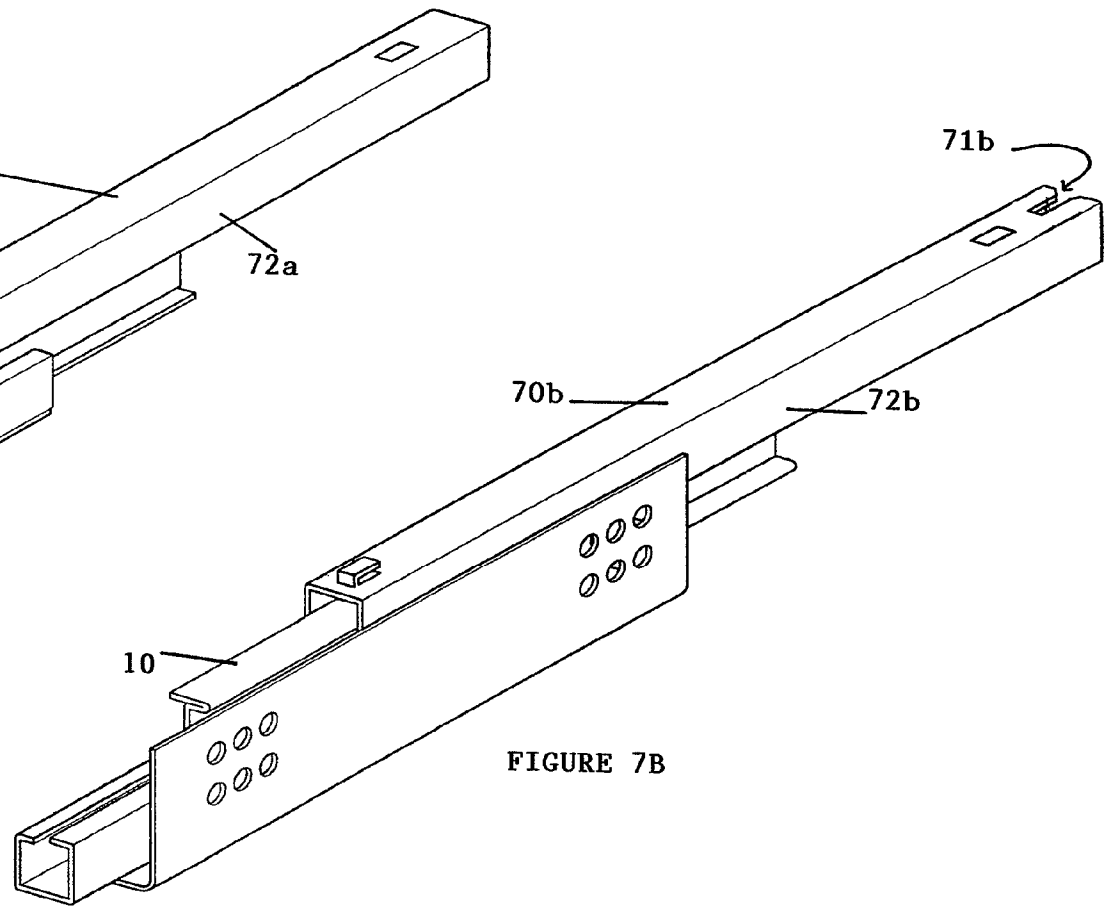
FIG. 7B shows the sliding guide rail system disposed within the support bracket having the stabilizer arrangement.
Figure 7A:
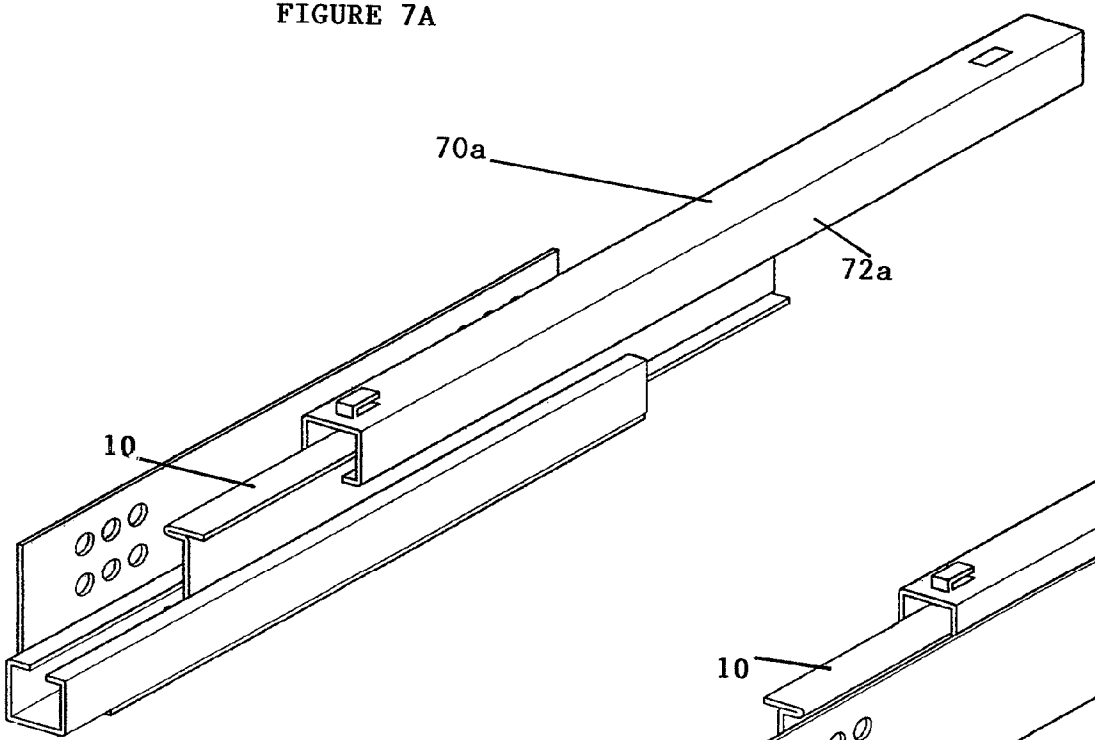
FIG. 7A shows the sliding guide rail system disposed within the support bracket without the stabilizer arrangement.

FIGS. 6A and 6B shows the stabilizer arrangement 8 that allows for the position of support bracket 60*b* relative to pull-out rail 70*b* to be adjustable laterally while guiding the movement of the pull-out rail 70*b* within support bracket 60*b*. The stabilizer arrangement 8 comprises a guide bracket 90, a lever 100, a connector 110 and a holder bracket 120.

Figure 5A:
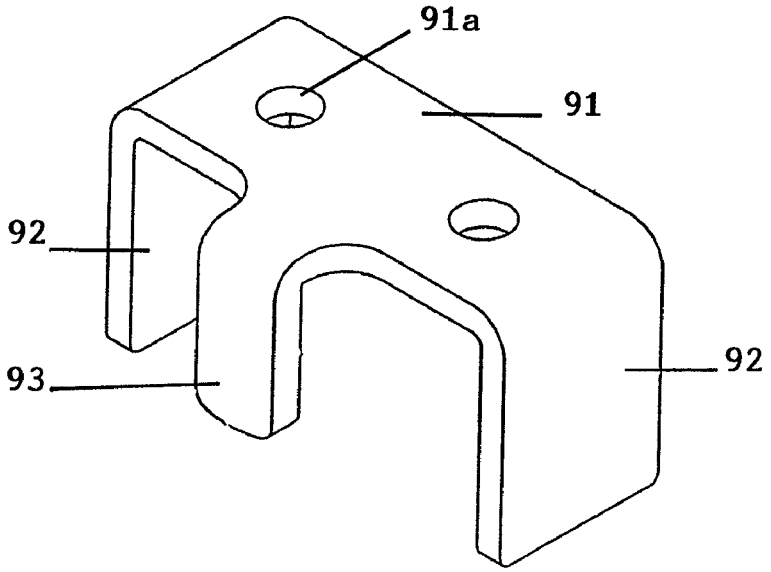
FIG. 5A shows the guide bracket of the stabilizer arrangement of FIG. 4.

The guide bracket 90, seen in FIG. 5A, is preferably made of metal and comprises a horizontal flange 91 with a pair of legs 92 disposed at each side of the flange 91. A centrally located protrusion 93 projects downwardly from a rear edge of the horizontal flange 91. The protrusion 93 is engageable within said support bracket slot 65*b* and the legs 92 are insertable into the support bracket edge openings 66*b*, thus, mounting the guide bracket 90 onto the support bracket 60*b*. The width of the support bracket slot 65*b* is oversized relative to the width of the guide bracket protrusion 93 such that the protrusion 93 is laterally movable within the slot 65*b*. Thus, the guide bracket 90 is laterally adjustable after being mounted onto the support bracket 60*b*. The guide bracket protrusion 93 is secured within the recess 71*b* of the pull-out rail 70*b*, through the support bracket slot 65*b*. The width of the pull-out rail recess 71*b* and the width of the guide bracket protrusion 93 are chosen such that the protrusion 93 is a tight fit within recess 71*b*. In other words, protrusion 93 is laterally moveable within slot 65*b* but not within recess 71*b*. Consequently, lateral movement of the protrusion 93 within slot 65*b* will result in the position of the support bracket 60*b* relative to the pull-out rail 70*b* being laterally adjusted.

Each leg 92 of the guide bracket 90 is located within the clearance 75*b* between the vertical flanges 72*b* of the pull-out rail 70*b* and the inner face of the L-shaped flange vertical portion 61*b*, at each side of the pull-out rail 70*b*. Thus, the pull-out rail 70*b* is guided or held between the guide bracket legs 92 that hang down, within the support bracket 60*b*.

Figure 5B:
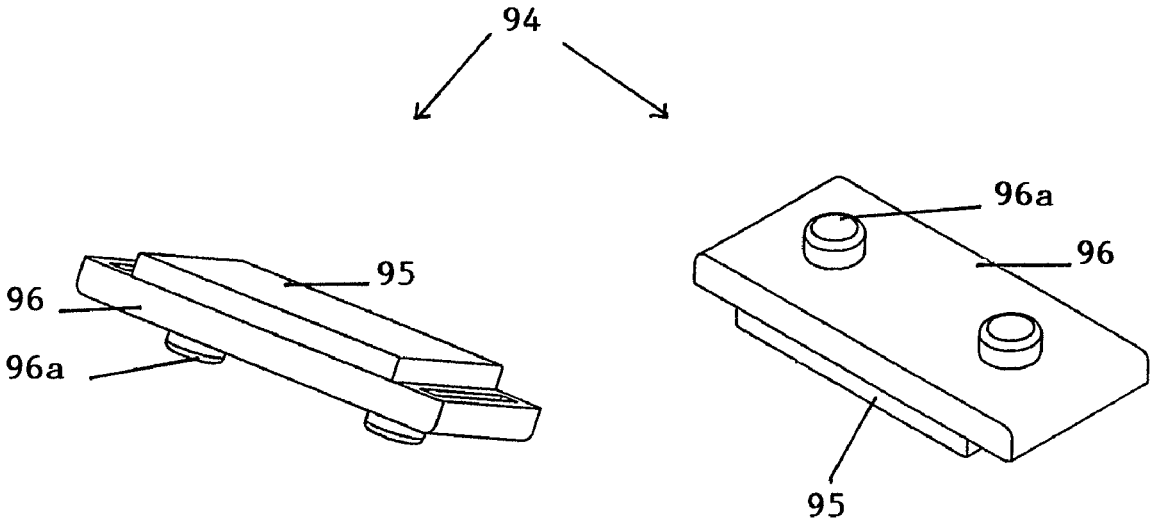
FIG. 5B shows the top and bottom perspective views of the guide bracket grip portion of the stabilizer arrangement of FIG. 4.

The guide bracket 90 is also provided with a grip portion 94 (shown in FIG. 5B) on the bottom face of its horizontal flange 91. Preferably, this grip portion 94 comprises a piece of resilient material 95 fixed onto a holding piece 96 with the holding piece being fitted underneath the guide bracket horizontal flange 91. The holding piece 96 is provided with a pair of connectors 96*a* that fit into a pair of corresponding apertures 91*a* on the horizontal flange 91. It is preferable that the resilient material 95 consists of rubber and the holding piece 96 is made of plastic. Obviously, this grip portion 94 should be fitted onto the guide bracket 90 prior to mounting the bracket on the support bracket 60*b*. The grip portion 94 of the guide bracket 90 is in contact with the top surface 63*b* of the support bracket 60*b*, when the bracket 90 is mounted thereon. The resultant gripping force will aid in the locking of the guide bracket 90 onto the support bracket 60*b*. However, the resilient nature of the grip portion 94 allows for slight lateral adjustments even after the guide bracket 90 is locked with the support bracket 60*b*. Any resilient material with a similar gripping ability as rubber can be used herein. Also, although it is preferable that the grip portion 94 is disposed as a separate structure from the guide bracket 90 as above described, it is also possible that the grip portion 94 be integral with the guide bracket 90.

The lever 100 (FIGS. 6A and 6B) is an inverted U-shaped bracket having a pair of outwardly extending planar flaps 101 at a first longitudinal end and a pair of nose-edged extensions 102 at the second longitudinal end. The lever 100 is further provided with a centrally located hole 103.

The lever 100 is supported on a holder bracket 120 (FIG. 4) that is fixed (preferably by welding) onto the top surface 63*b* of the support bracket 60*b*, in front of the support bracket slot 65*b* and edge openings 66*b*. The holder 120 has a vertical flange 121 and a horizontal flange 122 with the vertical flange 121 insertable into the recess of the lever 100. The vertical flange 121 of the holder 120 is provided with a hole 123 that corresponds to the central lever hole 103. The lever 100 is pivotally secured onto the holder bracket 120 by a screw or rivet through both the holder bracket and lever holes 123, 103. A pair of locators 124 is provided on the horizontal flange 122 of the holder bracket 120.

A connector 110 comprising a horizontal portion 111 and an angled portion 112 is engaged onto the holder bracket 120 (FIGS. 4, 6A and 6B). Holes 113 are provided on the horizontal portion 111 of the connector 110 for engagement with the locators 124 on the horizontal flange 122 of the holder 120. The angled portion 112 of the connector 110 terminates in a pair of spaced apart extensions 114. These connector extensions 114 are clipped onto the nose-edged extensions 102 of the lever 100, clamping the second end of the lever 100 between them. An upward force is exerted on that lever second end (with nose-edged extensions 102) by the connector 110, causing the lever first end (with outwardly extending planar flaps 101) to be biased downwards. The location of the lever 100 relative to the guide bracket 90 is such that the two outwardly extending flaps 101 are positioned on top of the guide bracket horizontal flange 91. Due to that first end of the lever 100 being biased downwards, constant pressure is exerted onto the guide bracket horizontal flange 91 by the lever flaps 101, thus preventing the guide bracket 90 from being vertically lifted from the support bracket 60*b*. In other words, the guide bracket 90 is locked onto the support bracket 60*b*.

Figure 9:
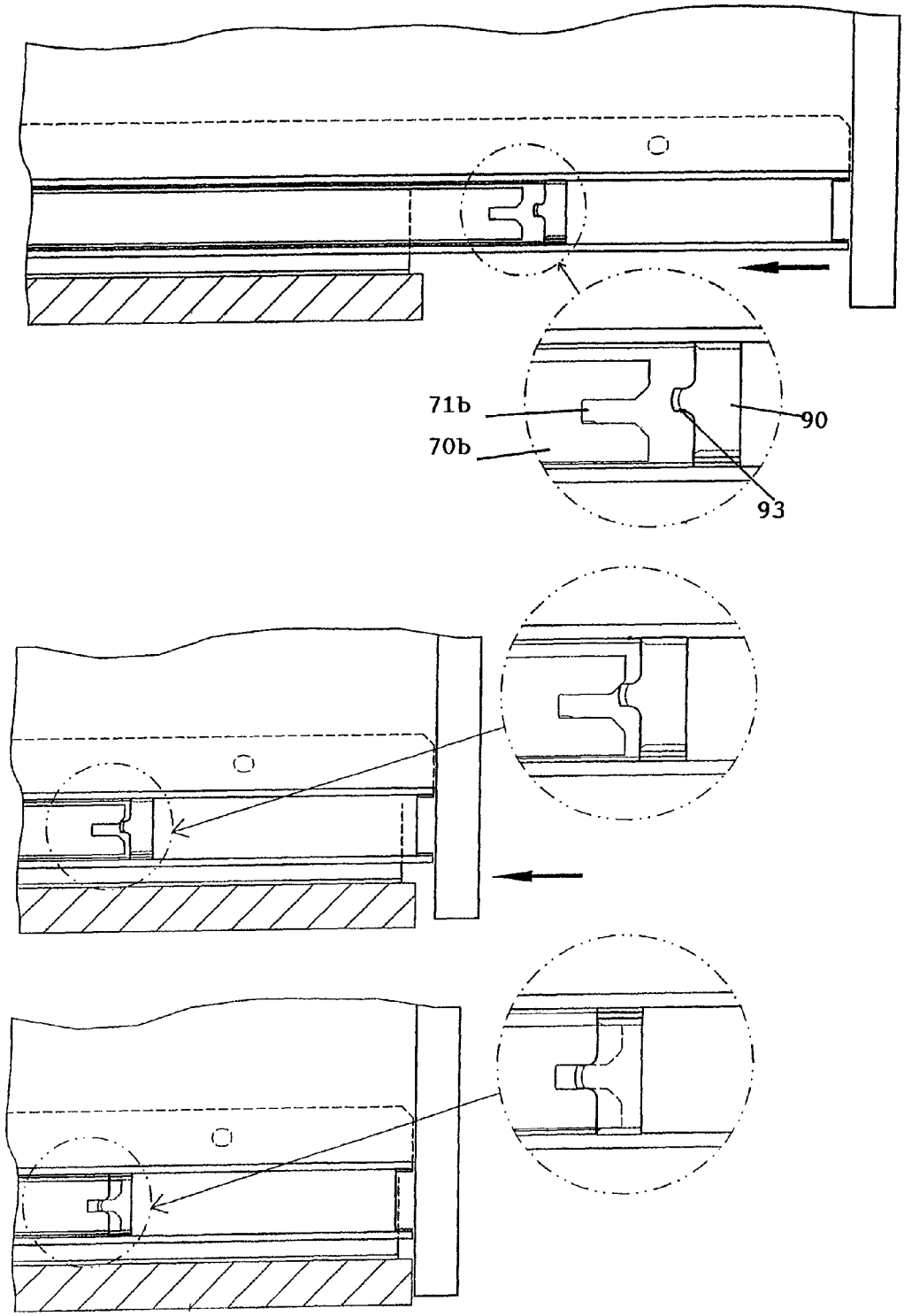
FIG. 9 shows sequential top views of the guide bracket protrusion being secured within the pull-out rail recess.

After the stabilizer arrangement 8 (guide bracket 90, lever 100, connector 110 and holder bracket 120) has been locked onto the support bracket 60*b*, the support bracket 60*b* is secured to the pull-out rail 70*b*, as shown in FIG. 9. Firstly, the pull-out rail 70*b* is pulled out from the article of furniture. Subsequently, the drawer (drawer bottom panel 3 sits on the horizontal portion 62*b* of the support bracket L-shaped flange) is pushed into the article of furniture. During the drawer closing movement, the guide bracket protrusion 93 that is projecting downwardly through the support bracket slot 65*b* will engage and be secured within the pull-out rail recess 71*b*. The inner side edges of the pull-out rail recess 71*b* are angled so as to guide (or ease) the guide bracket protrusion 93 as it is pushed longitudinally into the recess 71*b*. Once the guide bracket protrusion 93 is secured within the recess 71*b*, the sliding movement of the pull-out rail 70*b* will be guided in alignment with the support bracket 60*b*. As the width of the pull-out rail recess 71*b* and the width of the guide bracket protrusion 93 are almost similar, the protrusion 93 is securely held within the recess 71*b* once inserted. Further, the engagement clip (not shown) that releasably engages the support bracket 60*b* with the pull-out rail 70*b* also ensures that the protrusion 93 remains securely engaged within the recess 71*b* during subsequent sliding movement of the pull-out rail 70*b*.

It is preferred that the guide bracket 90 be located rearwardly of the lever 100, connector 110 and holder bracket 120 and the support bracket slot 65*b* be located rearwardly of the edge openings 66*b*, as seen in FIG. 3. Alternatively, it is also possible that the guide bracket 90 be located in front of the lever 100, connector 110 and holder bracket 120, in which case, the support bracket slot 65*b* should also be located in front of the edge openings 66*b*.

All directional statements such as front/forward, back/rear, top, bottom, lateral, vertical, inward, outward, made herein are relative to the orientation of the drawer assembly, in use.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefore intended to be embraced therein.

What is claimed is:

1. A drawer assembly comprising:

a drawer and a sliding guide rail system for slidably opening and closing the drawer within an article of furniture;

a support bracket (60*a*, 60*b*) for supporting said drawer, provided at each side of said drawer;

the sliding guide rail system including a pull-out rail (70*a*, 70*b*) disposed within each said support bracket;

one of said support brackets (60*b*) having a slot (65*b*), and the pull-out rail (70*b*) disposed within said one of the support brackets having a recess (71*b*);

a stabilizer arrangement (8) for stabilizing the sliding movement of said drawer, said stabilizer arrangement including a guide bracket (90) and a lever (100);

said guide bracket having a protrusion (93) engageable within said support bracket slot (65*b*), said slot being oversized relative to the guide bracket protrusion (93) such that said protrusion is laterally moveable within said slot; and said guide bracket protrusion (93) being secured within said pull-out rail recess (71*b*) through said support bracket slot (65*b*) such that lateral movement of the protrusion (93) within said slot (65*b*) adjusts the position of the pull-out rail (70*b*) relative to said one of the support brackets (60*b*); said stabilizer arrangement (8) further includes a resilient connector (110) operatively connecting said lever (100) with the guide bracket (90) such that said lever is biased to lock said guide bracket onto said one of the support brackets (60*b*); and said guide bracket (90) having a resilient grip portion (94) that allows for said guide bracket protrusion (93) to be adjustable laterally within said support bracket slot (65*b*) when said guide bracket is locked onto said one of the support brackets (60*b*).

2. A drawer assembly as claimed in claim 1 wherein said stabilizer arrangement (8) further comprises a holder bracket (120) affixed onto said support bracket (60*b*), for supporting said lever (100).

3. A drawer assembly as claimed in claim 2 wherein said connector (110) comprises a horizontal portion (111) and an angled portion (112), the horizontal portion affixed onto said holder bracket (120) and the angled portion adapted so as to clip onto an end of said lever (100) such that a constant upward force is exerted on said lever at said end.

4. A drawer assembly as claimed in claim 3 wherein said connector angled portion (112) terminates in a pair of extensions (114).

5. A drawer assembly as claimed in claim 4 wherein said guide bracket grip portion (94) comprises a piece of resilient material (95) disposed on said guide bracket (90) so as to be contactable with the top surface (63*b*) of the support bracket (60*b*).

6. A drawer assembly as claimed in claim 4 wherein said support bracket (60*b*) further comprises a pair of edge openings (66*b*), each edge opening provided at a side of the support bracket top surface (63*b*).

7. A drawer assembly as claimed in claim 2 wherein said guide bracket grip portion (94) comprises a piece of resilient material (95) disposed on said guide bracket (90) so as to be contactable with the top surface (63*b*) of the support bracket (60*b*).

8. A drawer assembly as claimed in claim 2 wherein said support bracket (60*b*) further comprises a pair of edge openings (66*b*), each edge opening provided at a side of the support bracket top surface (63*b*).

9. A drawer assembly as claimed in claim 3 wherein said guide bracket grip portion (94) comprises a piece of resilient material (95) disposed on said guide bracket (90) so as to be contactable with the top surface (63*b*) of the support bracket (60*b*).

10. A drawer assembly as claimed in claim 3 wherein said support bracket (60*b*) further comprises a pair of edge openings (66*b*), each edge opening provided at a side of the support bracket top surface (63*b*).

11. A drawer assembly as claimed in claim 1 wherein said guide bracket grip portion (94) comprises a piece of resilient material (95) disposed on said guide bracket (90) so as to be contactable with the top surface (63*b*) of the support bracket (60*b*).

12. A drawer assembly as claimed in claim 11 wherein said resilient material (95) comprises a rubber material.

13. A drawer assembly as claimed in claim 12 wherein said grip portion (94) is integral with said guide bracket.

14. A drawer assembly as claimed in claim 12 wherein said support bracket (60*b*) further comprises a pair of edge openings (66*b*), each edge opening provided at a side of the support bracket top surface (63*b*).

15. A drawer assembly as claimed in claim 5 wherein said grip portion (94) is integral with said guide bracket.

16. A drawer assembly as claimed in claim 15 wherein said support bracket (60*b*) further comprises a pair of edge openings (66*b*), each edge opening provided at a side of the support bracket top surface (63*b*).

17. A drawer assembly as claimed in claim 11 wherein said support bracket (60*b*) further comprises a pair of edge openings (66*b*), each edge opening provided at a side of the support bracket top surface (63*b*).

18. A drawer assembly as claimed in claim 1 wherein said support bracket (60*b*) further comprises a pair of edge openings (66*b*), each edge opening provided at a side of the support bracket top surface (63*b*).

19. A drawer assembly as claimed in claim 18 wherein said guide bracket (90) further comprises a pair of legs (92), each of said guide bracket legs insertable into a respective support bracket edge opening (66*b*) such that each leg is disposed between the pull-out rail (70*b*) and the support bracket (60*b*).

20. A drawer assembly as claimed in claim 1 wherein said connector (110) is made of spring steel.

* * * * *